United States Patent [19]

Brayton et al.

[11] 4,186,054

[45] Jan. 29, 1980

[54] PROCESS AND APPARATUS FOR PRODUCING BLAST FURNACE COKE BY COAL COMPACTION

[75] Inventors: William E. Brayton, Penn Hills Township, Allegheny County; Fay Fun, Monroeville; Luther G. Hendrickson, Churchill; Ronald W. Shoenberger, Monroeville, all of Pa.

[73] Assignee: United States Steel Corporation, Pittsburgh, Pa.

[21] Appl. No.: 865,818

[22] Filed: Dec. 30, 1977

[51] Int. Cl.[2] ..... C10B 53/08

[52] U.S. Cl. ..... 201/6; 44/10 R; 201/8; 201/24

[58] Field of Search ..... 44/10 R; 201/5, 6, 8, 201/41, 23, 24; 264/29.1, 29.3, 118; 423/449; 75/42, 44 R

[56] References Cited

U.S. PATENT DOCUMENTS

| | | | |
|---|---|---|---|
| 855,069 | 5/1907 | Sheldon | 201/5 |
| 2,466,435 | 4/1949 | Jones et al. | 44/10 R X |
| 2,594,226 | 4/1952 | Shea, Jr. | 201/5 X |
| 2,935,450 | 5/1960 | Jully | 201/8 |
| 3,010,882 | 11/1961 | Barclay et al. | 264/29.1 |
| 3,151,040 | 9/1964 | Jully | 264/29.1 X |
| 3,483,134 | 12/1969 | Olson | 201/6 X |
| 3,843,559 | 10/1974 | Repik et al. | 201/8 X |
| 3,966,561 | 6/1976 | Hinkley | 201/6 X |

FOREIGN PATENT DOCUMENTS

| | | | |
|---|---|---|---|
| 243852 | 2/1926 | Italy | 201/6 |
| 535333 | 11/1976 | U.S.S.R. | 201/6 |

OTHER PUBLICATIONS

Zielinski, H., *Present Methods of Coke Manufacture*, Warsaw, Poland, National Center for Scientific, Technical, and Economic Information, 1972, pp. 50–62, TT70-55025, published for Dept. of Interior, Washington, D. C.

*Primary Examiner*—Joseph Scovronek
*Assistant Examiner*—Roger F. Phillips
*Attorney, Agent, or Firm*—W. Gary Goodson

[57] ABSTRACT

The method of producing blast furnace coke by (1) compacting a finely divided coal wherein at least about 60% by weight of the coal has a diameter of less than about ⅛ inch to form a coal compact, which compact immediately after removal from the compacting means comprises at least about 20% by weight of particles having a particle size of less than ¼ inch in diameter; (2) breaking the thus formed compact such that the bulk density is sufficiently increased to be capable of conversion into coke suitable for use in large blast furnaces upon carbonization thereof; and (3) carbonizing the broken compact to thereby produce blast furnace coke having a minimum hardness of about 68 and a minimum stability of about 55. The compacting is preferably performed at a pressure equivalent to that achieved by passing the finely divided coal between rolls at a pressure applied to the coal of between about 20 and about 60 tons per lineal inch. Also preferably in the breaking step at least about 95% of the compacted coal is reduced to particle sizes ranging from about one inch to less than about 100 mesh.

The invention also includes apparatus for carrying out the above-described process.

24 Claims, 4 Drawing Figures

EFFECT OF TUMBLING TIME AND OIL ADDITION ON COKE STABILITY AND BULK DENSITY

BULK DENSITY AND SIZE DEGRADATION OF VARIOUS COMPACTS

PROCESS AND APPARATUS FOR PRODUCING BLAST FURNACE COKE BY COAL COMPACTION

BACKGROUND OF THE INVENTION

Metallurgical coke suitable for use in the very large blast furnaces being built today must have very high coke strength as indicated by hardness and stability. A minimum hardness of about 68 and a minimum stability of about 55 are generally essential. "Stability" as defined herein is the strength of the coke to withstand breakage as given by the ASTM Stability Index test and "hardness" as defined herein is the measure of coke hardness indicated by the ASTM Hardness Index test, according to ASTM Procedure D3402. To achieve this quality of coke requires the use of expensive high quality coking coals having a high percentage of volatiles in the coal, a high fluidity and a relatively low percentage of inert components. Due to the desire to use less expensive coals and also due to the decreasing supply of the high quality metallurgical grade coals great effort has been expended upon ways of achieving high strength coke using lower quality coals. See "The Critical Case of Coke," Journal of Metals, February 1972, pp 32–34, incorporated herein by reference.

The Japanese, for example, have conducted several studies on how to combat the decrease in coke quality due to the use of inferior coals. Controlling the size of the coal being charged to up to about 90% below 3 mm diameter plus adding oil to remedy the lower bulk density resulting from the harder crushing has been developed by Nippon Steel. This process is very expensive due to the high cost of oil. Another technique also developed by this same company involves mixing coal briquettes with charging coal. This technique (1) has limitations on the bulk density of the charge due to difficulties in pushing, (2) requires increased surveillance of temperature control and distribution in the coking chambers, and (3) has problems with segregation of briquettes in the charge.

Formcoke is another approach being pursued but due to the high cost of such coke it is believed to be only a supplementary source for coke requirements.

Preheating of the finely ground coal charged to the coke ovens is currently used commercially to achieve high coke strength from lower quality coals. However, in addition to being costly due to the energy demands for heat and capital costs this process is very dusty. This dustiness besides being a pollution problem results in coal dust getting mixed with the pitch and other liquid hydrocarbons produced as a by-product from the coke ovens, thus destroying the value of these hydrocarbons for certain chemical uses, such as for making electrodes.

A method of coal compaction which is currently used for coke making in certain parts of the world is "stamp charging". In this method the entire quantity of coal is first compacted into one big block. The ovens are then opened and the solid block is pushed into the oven. Since the oven must be open during the charging, there are very serious pollution problems due to the dust and fumes given off during the charging. See N. N. Das Gupta, The Use of Tall Ovens and Stamp Charging for Coking Indian Coals, Journal of Mines, Metals, and Fuels, Vol. 14, No. 8, August, 1966, pp 256–263; and Coke and Chemistry, U.S.S.R., No. 12, 1960, pp 54–58; each incorporated herein by reference.

A process for producing coke comprising briquetting finely divided coal followed by increasing the bulk density prior to the carbonization step by filling the free spaces between the briquette with chippings is taught in Henry Zielinksi, "Present Method of Coke Manufacture," (1972) pp 58–62, incorporated herein by reference. However, this process requires the briquette chippings be screened off and returned for briquetting again. This screening step is an additional expense as well as cutting down on the rate of throughput of coal through the process, thus decreasing the efficiency of the process. The screening step also aggrevates the already serious air pollution problem caused by dustiness from the briquettes.

SUMMARY OF THE INVENTION

Applicants' solution to this problem of producing high strength blast furnace coke is achieved by (1) compacting a finely divided coal wherein at least about 60% by weight of the coal has a diameter of less than about ⅛ inch to form a coal compact, which compact immediately after removal from the compacting means comprises at least about 20% by weight of particles having a particle size less than about ¼ inch in diameter; (2) breaking the thus formed compact such that the bulk density is sufficiently increased to be capable of conversion into coke suitable for use in large blast furnaces upon carbonization thereof; and (3) carbonizing the broken compact to thereby produce blast furnace coke having a minimum hardness of about 68 and a minimum stability of about 55. The compacting step is preferably performed at a pressure equivalent to that achieved by passing the finely divided coal between rolls at a pressure applied to the coal of between about 20 and about 60 tons per lineal inch. Also preferably in the breaking step at least about 95% of the compacted coal is reduced to particle sizes ranging from about one inch to less than about 100 mesh.

The invention also includes apparatus for carrying out the above-described process.

By the method and apparatus of this invention high strength coke can be achieved without using expensive oil to control bulk density. Also, it is possible with this process to decrease the dustiness problem and obtain coke of improved strength when compared to the preheating process described above. Also, the capital expense is relatively small due to the relatively simple compaction means that can be utilized. No costly, energy-consuming heating steps are required as in the above-mentioned preheating process and other hot briquetting processes of the prior art.

No screening or otherwise separating the compacts or the broken compacts is necessary according to the process of this invention. Thus, process cost is decreased due to elimination of steps an increasing coal throughput and therefore efficiency of the process compared to some of the aforementioned prior art processes.

Also, the coke oven charging of this invention can be performed by the gravity flow method with the ovens closed. Thus the serious pollution problems of the stamp charging method is overcome.

In addition or alternatively to being able to use lower quality, less expensive coals, the process of this invention allows the coking rate to be increased. This means that more coke per oven can be produced, if desired, thus resulting in potential labor and materials savings.

DESCRIPTION OF THE DRAWINGS AND PREFERRED EMBODIMENT(S)

The finely divided coal of this invention is preferably coking coal but due to the increased strength obtained by the process of this invention the blended coals utilized may contain reduced amounts of higher quality coals such as low and medium volatility coking coal. A preferred coal is a blended coal containing a majority of coal of high volatile A rank or higher and wherein the coal contains up to 20% by weight of inert materials.

Preferably the majority of the coal is a blended coking coal having from about 15 to about 40% volatile matter, a minimum free-swelling index of 4, and of such a nature as to not produce pressures in excess of about two pounds per square inch on oven walls. See R. J. Gray, "Selection of Coals for Coke Making," Geological Survey Circular 757, pp 15–16, 1977, incorporated herein by reference.

The finely divided coal is preferably produced by conventional grinding or pulverizing means to the desired diameter of less than about ⅛ inch.

The process may be carried out by adding a liquid additive to the finely divided coal in an amount up to 10% by weight of the finely divided coal in the compacting step as a means of controlling the dust. Preferably, the finely divided coal will contain between about 4 and about 10% by weight and more preferably between about 6 and about 10% by weight of moisture. Additionally or alternatively, the finely divided coal may contain up to about 3% by weight of a conventional liquid binder. The liquid binder is preferably a hydrocarbon such as pitch or liquid tar.

The compacting step of the process of this invention is preferably carried out by applying high pressures on the finely divided coal to thereby form a coal compact having a specific gravity of at least about 1.1 and more preferably at least about 1.15. The compaction step is preferably performed in the absence of an externally applied liquid binder.

An alternate method of carrying out this invention is by first passing the finely divided blended coal through a precompaction means followed by passing it through a compaction means. It is also preferred to break up the precompacted coal prior to passing it through the compaction means.

The compaction means may be in any form suitable for compacting the finely divided coal to achieve the desired results. However, compaction means in the form of rolls have been found to be preferable due to the ease of applying high pressures to the finely divided coal. Both smooth and indented briquetting rolls may be used there. Briquetting rolls are preferred due to the ability to get a higher through-put of material per set of rolls.

The binderless compact formed according to this invention is relatively fragile compared to the compact of some prior art processes. Generally the compact immediately after removal from the compact means comprises at least about 20% by weight of particles having a particle size of less than about ¼ inch in diameter. In the preferred process when only one compaction step is utilized then the coal compact immediately after removal from the compacting means generally comprises between about 50% and about 80% particles having a diameter of less than about ⅛ inch and between about 20% and 50% particles having a diameter of more than about ⅛ inch. It is believed that the nature of the coal, the nature and amount of additives, and/or the amount and type of compaction contribute to the nature of the final compact prior to carbonization which ultimately results in the improved results noted in this invention.

The finely divided coal has properties which allows it upon high pressure compaction as described above to develop strong cohesive forces between the coal particles to produce coal compacts of a specific gravity of at least 1.1 and more preferably such that upon controlled handling allows the compacts to partially break up into broken compacts. The individual broken compacts generally maintain the increased density achieved in the compaction step.

The breaking step of the process of this invention may be carried out by any suitable means to achieve the desired high bulk density in the carbonizing means. This may be accomplished by tumbling, by pulverizing or by controlled handling in transferring the compacted coal. Preferably between about 30% and about 70% by weight of broken compacts which enter the carbonizing means have a particle size of greater than ¼ inch. Preferably, at least about 95% of the compacted coal is reduced in the breaking step to a particle size having diameters ranging between about 1 inch to less than about 100 mesh. More preferably, the sizes of the broken compacts after the breaking step are as follows:

(a) particle size greater than 1 inch in diameter present in an amount of less than about 5 percent by weight;
(b) particle size less than about 1 inch in diameter to about ¼ inch present in an amount of between about 20 percent by weight to about 50 percent by weight;
(c) particle size less than about ¼ inch in diameter to about 100 mesh present in an amount of between about 40 percent by weight to about 70 percent by weight;
(d) particle size less than about 100 mesh present in an amount of between about 5 percent by weight and about 30 percent by weight.

The blast furnace coke of this invention has a minimum hardness of about 68 and a minimum stability of about 55 and preferably a minimum stability of about 58.

The coking rate of this invention may be varied to whatever rate is acceptable in the art. However, one of the advantages of this invention is that the coking rate may be increased since the coke strength is improved by the process of the invention. A preferred coking range is greater than about 1 inch per hour and more preferably greater than about 1.2 inches per hour.

The bulk density of the oven charge should preferably be about 45 to about 55 pounds per cubic foot.

Figure 3:
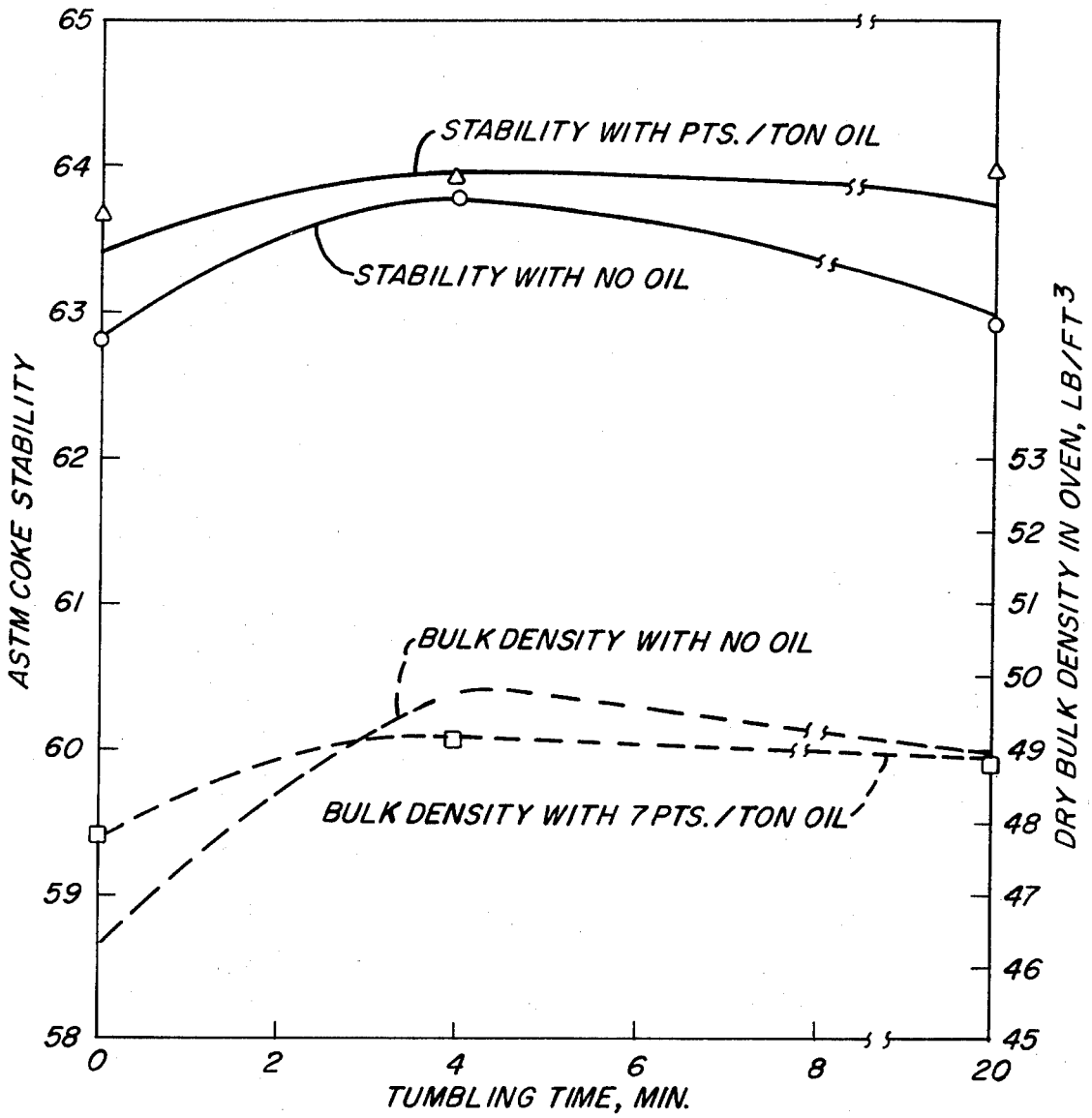

FIG. 3 plots the ASTM coke stability as a function of compact tumbling time for some of Examples 1–7.

Figure 4:
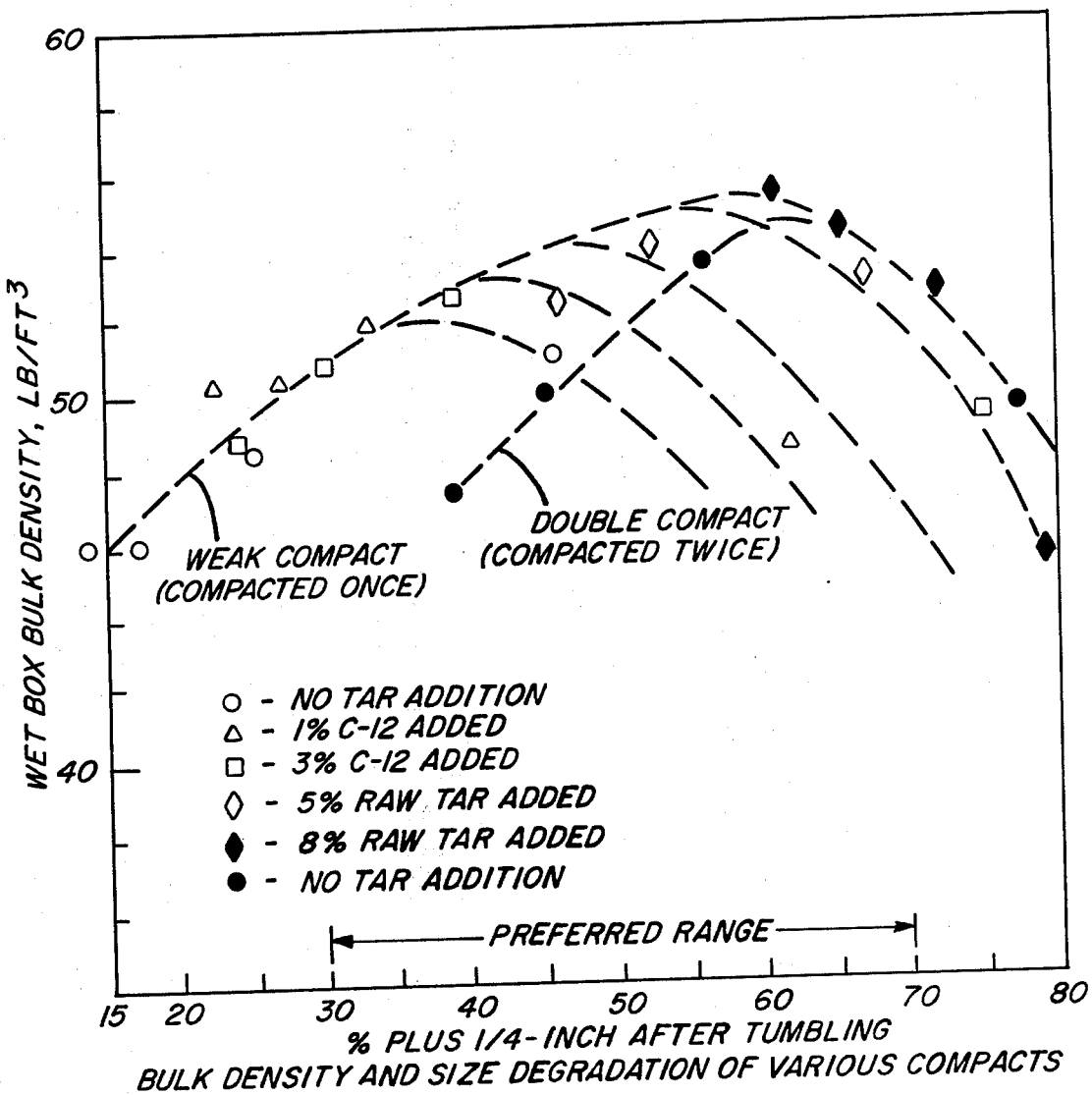

FIG. 4 plots the bulk density as a function of the percentage of plus ¼ inch broken compacts present after tumbling.

Figure 1:
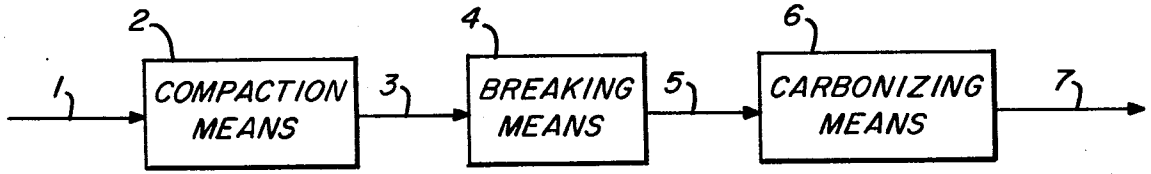
FIG. 1 is a flow diagram showing the process and apparatus for producing high-strength blast furnace coke by first passing the finely divided coal through a compaction means, then a breaking means and then finally through the carbonizing means.

In FIG. 1, finely divided coal as described above is passed by transport means into compaction means 2 where a compact is formed by high pressures such as described above. This compaction step is accomplished without the use of any binder which provides significant adhesive properties for holding the compact together. As described above, water or other liquid additive may be added to the finely divided coal as a means of dust control. While this liquid additive may provide some increased strength to the compact formed, this will play only a minor part and is not essential to the step of forming the compact. No externally applied heat is required in the compaction step although some heat may be generated by the friction, etc. involved in compaction. The thus formed compact is passed from compaction means 2 by transport means 3 to the breaking means 4 where the compact pulverized or otherwise broken in a controlled manner to form broken compacts of the desired size range to achieve the desired high bulk density in the carbonizing means. Transport means 3 and 5 may function as part or all of the breaking means 4. The broken compacts are then passed by transport means 5 to carbonizing means 6 where a high-strength blast furnace coke is produced. This coke is removed by removal means 7 for use in large metallurgical blast furnaces.

Figure 2:
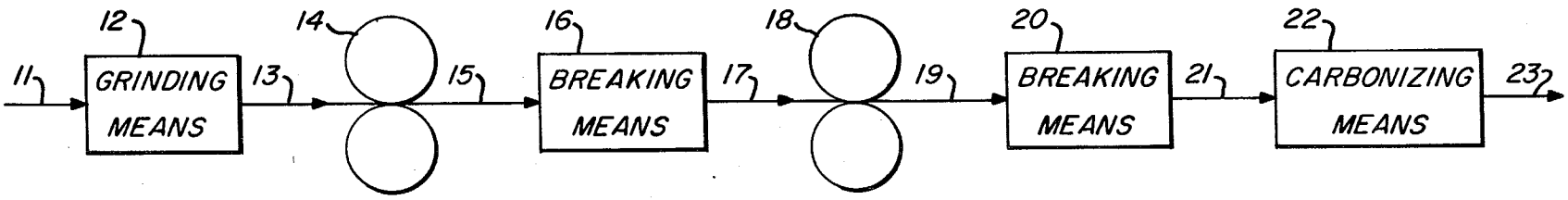
FIG. 2 is a flow diagram showing a preferred embodiment of this invention wherein coal is first passed through grinding means and then through precompaction means in the form of rolls, breaking means, then compaction means in the form of rolls, then additional breaking means and finally through the carbonizing means.

FIG. 2 shows a preferred embodiment of the invention illustrated in FIG. 1. A blended coal of suitable grade for use in this invention is conveyed by transport means 11 into grinding means 12 where a finely divided coal is formed, which in turn is passed by transport means 13 to pre-compaction means 14 in the form of rolls capable of applying the desired high pressures utilized herein. The compact thus formed is passed by transport means where the compact is preferably broken prior to passing by transport means 17 to compaction means 18 in the form of rolls to form a compact of increased density. The thus formed compact is then passed by transport means 19 to breaking means where broken compacts of a desired size range are produced in a controlled manner to achieve the desired high bulk density. The broken compacts are then passed by transport means 21 to carbonizing means 22 prior to removal of the high-strength coke thus formed by removal means 23.

The following examples are given by example only and are not intended to limit the scope of the invention.

EXAMPLES 1–7

Coal compacts made from a batch of base blend consisting of 70 weight percent Corbin and 30 weight percent Alpheus coals finely divided to 95 percent minus ⅛ inch were produced by a process such as outlined in the description of FIG. 1 and carbonized in the laboratory 500-pound test carbonizing oven. Immediately before charging the compacts to the oven, the compacts were broken by tumbling for various lengths of time in a blender to simulate various degrees of rough handling, and the moisture level was adjusted to 6.0 percent (oil was added when desired after the blender tumbling treatment). The results obtained generally show that higher stability coke is obtained at an optimal tumbling time of 4 minutes corresponding to the maximum dry oven bulk density of the compacts charged. However, in this series of examples, there was no apparent benefit from adding oil to the compacts charged. The maximum ASTM stability both oiled and unoiled charges is about 64. A reference test using uncompacted 95 percent minus ⅛ inch finely divided coal produced coke having a stability of 55.5. The results are shown in Table I and FIG. 3.

These results indicate that applicants' process of this invention of cold compacting finely divided coals without a binder is an effective method for improving coke stability by several points.

Without compaction, as shown in Example 7, a batch of 95 percent minus ⅛ inch coals produced oven bulk density of 47.8 lb/ft$^3$ and ASTM coke stability of 57. By forming the coals into compacts without a binder and subsequently tumbling the compacts for 4 minutes, the resulting coal charge bulk density increased to 49.1 lb/ft$^3$ and the resultant coke stability increased to 64 (Example 4).

This initial base blend of 70 weight percent Corbin and 30 weight percent Alpheus coals has the following characteristics (percentages are by weight):

| | |
|---|---|
| Volatile Matter | 30.3% |
| Ash | 6.3% |
| Sulfur Content | 0.66% |
| Free Swelling Index | 6.5% |
| Petrographic Composition | |
| Balance Index | 1.72% |
| Rank Index | 3.97% |
| Average Reflectance (percentage reflectance in oil) | 1.06% |

Table I

| Example No. | 1 | 2 | 3 | 4 | 5 | 6 | 7 |
|---|---|---|---|---|---|---|---|
| Processing | | | | | | | |
| Compaction | Yes | Yes | Yes | Yes | Yes | Yes | No |
| Blender Tumbled | None | None | 4 min. | 4 min. | 20 min. | 20 min. | No |
| Oil Addition, PPT* | 0 | 7 | 0 | 7 | 0 | 7 | 7 |
| Moisture, % | 6 | 6 | 6 | 6 | 6 | 6 | 6 |
| Dry Bulk Density, Lb/Ft$^3$ | 46.3 | 47.7 | 49.8 | 49.1 | 49.0 | 48.9 | 47.8 |
| Coking Rate, In/Hr | 0.97 | 0.98 | 0.99 | 0.99 | 0.96 | 1.00 | 0.95 |
| Final Coke Temperature, °F. | 1910 | 1880 | 1915 | 1890 | 1880 | 1880 | 1910 |
| Coke Quality | | | | | | | |
| ASTM Coke Stability | 63.0 | 63.5 | 64.0 | 64.0 | 63.0 | 64.0 | 55.5 |
| ASTM Coke Hardness | 75.5 | 74.5 | 74.5 | 74.5 | 75.0 | 75.0 | 70.0 |
| Coke Size, Cum. % | | | | | | | |
| +3" | 14.2 | 15.7 | 14.3 | 11.4 | 10.9 | 12.7 | |
| +2" | 62.5 | 65.2 | 60.9 | 61.5 | 60.2 | 58.9 | 73.0 |

Table I-continued

| Example No. | 1 | 2 | 3 | 4 | 5 | 6 | 7 |
|---|---|---|---|---|---|---|---|
| 30 1" | 95.9 | 95.6 | 96.0 | 95.5 | 95.7 | 95.1 | 96.5 |
| 30 ½" | 97.7 | 97.4 | 97.6 | 97.1 | 97.4 | 97.0 | |
| Pressure on Wall During Coking, psi | 1.0 | 0.9 | 1.0 | 1.1 | 0.8 | 0.9 | 0.9 |

*PPT = Pints Per Ton

EXAMPLES 8–10

Examples 8–10 were performed using the same finely divided coal and same procedure as was used in Examples 1–7. The salient results are summarized in Table II.

At lower moisture content (4.5% instead of 6.0% in Example 4), the compacts (Example 8) resulted in slightly lower coal bulk density and coke stability (48.5 vs 49.1 lb/ft$^3$ for Example 4 and 61.6 vs 64 for Example 4).

To investigate the effect of coal handling on the breakage of the compacts, the compacts were processed through the coal handling system in two ways. In the first case (Example 9), the compacts were discharged to a bucket elevator which carried them to a conveyor. From the conveyor, the compacts were allowed to drop approximately 20 feet into a holding bin. This treatment probably represents the most severe conditions that may be expected in a commercial plant. As a result, the compacts degraded and produced bulk density of only 43.1 lb/ft$^3$ and stability of 57. In the second case (Example 10), the 20 feet vertical drop of the compacts was moderated by a sample splitter deflection plate so that the drop was effected in two stages. The compacts were not as severely degraded and slightly improved stability (60) was obtained. Oil was not added to either of these samples after degradation.

Table II

| Example No. | 8 | 9 | 10 |
|---|---|---|---|
| Processing | | | |
| Compaction | Yes | Yes | Yes |
| Treatment of Compact | Blender Tumbled 4 min. | Through Regular Coal Handling System | Through Coal Handling With Sample Splitter |
| Oil Addition, PPT* | 7 | 0 | 0 |
| Moisture, % | 4.5 | 6 | 6 |
| Dry Bulk Density, Lb/Ft$^3$ | 48.5 | 43.1 | 43.2 |
| Coking Rate, In/Hr | 1.0 | 0.99 | 0.97 |
| Final Coke Temp, °F. | 1900 | 1890 | 1920 |
| Coke Quality | | | |
| ASTM Stability | 61.5 | 57.0 | 60.0 |
| ASTM Hardness | 74.0 | 69.0 | 74.0 |
| Coke Size, Cum. % | | | |
| +2" | 60.0 | 64.5 | 62.0 |
| +1" | 98.0 | 96.0 | 96.0 |
| Pressure on Wall During Coking, psi | 1.1 | 0.8 | 1.1 |

*PPT = Pints Per Ton

EXAMPLES 11–15

As an attempt to reduce dustiness of the compacts in the coal-blend compaction method of this invention, various amounts of C-12 coal tar pitch (a commercial blend) and raw flushing liquor tar were added to the Clairton Group 31 blend of finely divided coking coal before compacting. As shown in Table III, lower dustiness indices were observed for the compacts with pitch or tar addition as compared to compacts without additions.

Pitch and tar addition did not affect the resulting coke quality significantly. The low coke stabilities reported in the last two sets of Table III may be caused by experimental errors. In general, similar coke qualities are expected from compacts with or without pitch or tar additions.

The most significant contribution of tar or pitch is the increased strength of the compacts. FIG. 4 represents the bulk density as a function of plus-¼-inch partial compacts after blender tumbling to produce various degrees of breakage. The maximum obtainable bulk density (at the apex of each curve) increases steadily as the amount of tar or pitch increased. Simultaneously, the higher bulk densities are obtained at higher plus-¼-inch fractions and correspond to longer tumbling times, viz:

| Compacts With | Maximum Wet Box Bulk Density | Plus ¼ Inch | Approximate Time Tumbled |
|---|---|---|---|
| No Tar Added | 52 lb/ft$^3$ | 35% | 5 min. |
| 1% C-12 Pitch | 53 lb/ft$^3$ | 42% | 5 min. |
| 3% C-12 Pitch | 54 lb/ft$^3$ | 48% | 5 min. |
| 5% Raw Tar | 55 lb/ft$^3$ | 55% | 15 min. |
| 8% Raw Tar | 55.5 lb/ft$^3$ | 60% | 40 min. |

In summary, tar or pitch addition improves the strength of compacts such that greater bulk density can be obtained after more severe handling and decreases the dustiness of handling to a certain extent. The coke quality essentially is not affected by pitch or tar additions.

Table III

| Example No. | | 11 | 12 | 13 | 14 | 15 |
|---|---|---|---|---|---|---|
| Coal Blend | | 95% - ⅛" Clairton Group 31 Blend | | | | |
| Compaction | | Standard Weak Briquettes Made at Universal | | | | |
| Conditioning | | 5 Minute Blender Tumbling | | | | |
| Tar or Pitch Added | | None | 1% C-12 | 3% C-12 | 5% Raw Tar | 8% Raw Tar |
| Oil Added During Compaction | Pint/Ton cm$^3$/kg | 6 | 6 | 6 | 6 | 6 |

Table III-continued

| Example No. | | 11 | 12 | 13 | 14 | 15 |
|---|---|---|---|---|---|---|
| Dustiness of Conditioned Compact | | | | | | |
| ASTM Coarse Index | | 707 | 78 | 123 | 200 | 205 |
| ASTM Fleat Index | | 13 | 11 | 16 | 27 | 21 |
| Oven Charge | | | | | | |
| Size +¼" (6 mm) | % | 40.4 | 29.5 | 43.2 | 61.2 | 63.2 |
| −⅛" (3 mm) | % | 57.4 | 66.1 | 52.3 | 36.2 | 32.3 |
| −100M (0.15 mm) | % | 15.4 | 20.7 | 16.2 | 10.5 | 7.5 |
| Moisture | % | 4.5 | 4.2 | 4.5 | 4.8 | 3.5 |
| Dry Bulk Density | Lb/Ft$^3$ | 52.2 | 51.9 | 51.4 | 51.1 | 49.3 |
| Coking Conditions | | | | | | |
| Coking Rate | In/Hr | 0.96 | 1.01 | 1.01 | 0.96 | 0.92 |
| Final Coke Temp. | °F. | 1900 | 1940 | 1930 | 1860 | 1890 |
| Coking Pressure | psi | 1.7 | 1.3 | 1.4 | 0.8 | 1.0 |
| Coke Quality | | | | | | |
| ASTM Stability | | 60.0 | 60.5 | 59.5 | 59.0 | 57.0 |
| ASTM Hardness | | 68.5 | 70.5 | 70.5 | 69.5 | 66.5 |
| Size +2" (50 mm) | % | 71.4 | 68.6 | 72.2 | 65.5 | 60.7 |
| −1" (25 mm) | % | 4.2 | 5.8 | 4.7 | 5.6 | 6.2 |
| −½" (13 mm) | % | 2.5 | 3.5 | 2.6 | 3.1 | 3.7 |

EXAMPLES 16–18

A 200-ton batch of coking coals was processed in commercial-sized machines according to the present method at Gary Works of U.S. Steel Corporation at Gary, Indiana. The 93% minus ⅛ inch pulverized coal in Examples 17 and 18 was taken from the coal preparation plant of the No. 2 coke battery. It was trucked 15 miles to the briquetting facility of National Briquetting Company, East Chicago, Indiana. The briquettes produced was trucked back to No. 16 coke battery of the Gary Works. The briquettes were finally charged to coke ovens of the No. 16 battery by way of larry cars, after numerous dumping, conveying and transferring to produce a broken compact of a desired bulk density.

Briquettes taken directly from the briquetting facility and shipped to the laboratory were tumbled in a twin-cone Research blender for various lengths of time. The results indicate that the 5-minute tumbled product is approximately about the same as the oven charges of coal in Examples 17 and 18 insofar as the plus-⅛-inch fraction of coal is concerned. However, the 40-minute tumbled product appears to be similar to the oven charges of coal insofar as plus-¼-inch coarse particles and bulk densities are concerned.

The result of this test at the plant is compared with laboratory results and normal plant results using conventional method as shown in Table IV.

It is clear that by the method of coal-blend-compacting, greater oven bulk density and considerably higher coke stability were achieved than by conventional method without blend compaction. Furthermore, the plant results are well substantiated by results in the laboratory using the same batch of compacted, blended coal.

Table IV

| Comparison of Plant and Laboratory Results | | | | | | | |
|---|---|---|---|---|---|---|---|
| Ex. No. | Type of Charge and Conducted at | Moist. % | Coal Grind % Minus ⅛ in. | Oven Bulk Density, dry lb/ft$^3$ | Coking Rate in/hr | ASTM Coke Stability Avg. | ASTM Coke Stability Range |
| 16 | Gary No. 16 Battery Normal Charge Not Compacted | 6.3 | 80 | 46.3 | 0.85 | 50 | 43–56 |
| 17 | Gary No. 16 Battery N.B.C. Briquettes Coal-Blend-Compaction | 5.0 | 93 | 48.5 | 0.85 | 60 | 56–64 |
| 18 | Res. Lab. 500 Lb-Oven N.B.C. Briquettes Coal-Blend-Compaction | 4.5 | 93 | 47.5 | 1.0 | 59 | 57–61 |

*Coal Blend = 60% Corbin, 30% Alpheus and 10% Wentz Coking Coals

We claim:

1. A method of producing blast furnace coke comprising:

(a) compacting a finely divided coal comprising a majority of coking coal and wherein at least about 60% by weight of the coal has a diameter of less than about ⅛ inch to form a coal compact, said compact immediately after removal from the compacting step comprising at least about 20% by weight of particles having a particle size of less than about ¼ inch in diameter;

(b) breaking the thus formed compact to increase the percentage of compacts having a particle size below about ¼ inch diameter such that the bulk density is sufficiently increased to be capable of conversion into coke suitable for use in large blast furnaces upon carbonization thereof; and (c) carbonizing the broken compact to thereby produce blast furnace coke having a minimum hardness of about 68 and a minimum stability of about 55.

2. Method as in claim 1 wherein the coal is a blended coal and wherein the compaction step is carried out by applying high pressures on the finely divided coal to thereby form a coal compact having a specific gravity of at least about 1.1.

3. Method as in claim 2 wherein the compaction step is carried out in the absence of an externally applied liquid binder, wherein the broken compacts from step (b) are transported by gravity charging into a closed coke oven for the carbonizing of step (c), and wherein the coal compact immediately after removal from the compacting step (a) comprises between about 50% to 80% by weight of particles having a particle size of less than about ¼ inch in diameter.

4. Method as in claim 2 wherein the compaction step is carried out by first passing the finely divided blended coal through a pair of precompaction rolls followed by one or more pairs of compacting rolls.

5. Method as in claim 4 wherein the compact formed by passing the blended coal through the precompaction rolls is broken before being passed through one or more pairs of compacting rolls.

6. Method as in claim 2 wherein a liquid additive is added to the blended coal in an amount of up to about 10% by weight of the blended coal in the compacting step as a means of controlling the dust.

7. Method as in claim 2 wherein the compact formed by compacting is a briquette and has a specific gravity of at least 1.15.

8. Method as in claim 4 wherein the breaking is accomplished by controlled handling of the compact between the compacting step and the step of subjecting the oven contents to carbonization.

9. Method as in claim 2 wherein at least 90% by weight of the coal has a diameter of less than about ⅛ inch and wherein up to about 3% by weight of a conventional liquid binder is added to the blended coal in the compacting step as a means of controlling the dust and wherein the resulting blast furnace coke has a minimum stability of about 58.

10. Method as in claim 2 wherein the blended coal contains between about 4 and about 10 percent by weight of moisture.

11. Method as in claim 10 wherein the blended coal contains between about 6 and about 10 percent by weight of moisture.

12. Method as in claim 2 wherein the coking rate is greater than about 1 inch per hour.

13. Method as in claim 2 wherein the blended coal contains a reduced amount of low and medium volatile coking coal.

14. Method as in claim 13 wherein the blended coal contains no low volatile coking coal.

15. Method as in claim 2 wherein the majority of the coal is high volatile A rank or higher and wherein the coal contains up to 20% by weight inert materials.

16. Method as in claim 3 wherein the compacting step is carried out between rolls which produce heat which improves the bond formed between the coal particles.

17. Method as in claim 16 wherein the pressure applied to the coal between the rolls is between about 20 and about 60 tons per lineal inch of roll length.

18. Method as in claim 2 wherein in the breaking step at least about 95 percent of the compacted coal is reduced to particle sizes having diameters ranging from about 1 inch to less than about 100 mesh.

19. Method as in claim 18 wherein immediately after the breaking step the following particle sizes of the broken compacts are present:

(a) particle size greater than 1 inch in diameter present in an amount of less than about 5 percent by weight;

(b) particle size less than about 1 inch in diameter to about ¼ inch present in an amount of between about 20 percent by weight to about 50 percent by weight;

(c) particle size less than about ¼ inch in diameter to about 100 mesh present in an amount of between about 40 percent by weight to about 70 percent by weight;

(d) particle size less than about 100 mesh present in an amount of between about 5 percent by weight and about 30 percent by weight.

20. Method as in claim 2 wherein the bulk density of the coal achieved in the coke oven is between about 45 and about 55 pounds per cubic foot.

21. Method as in claim 19 wherein different types of compacts are blended to achieve a bulk density of the coal in the coke oven of between about 45 and about 55 pounds per cubic foot.

22. A method of producing blast furnace coke in a conventional coking oven consisting essentially of:

(a) compacting a finely divided blended coking coal by high pressure means wherein at least about 60% by weight of the coal has a diameter of less than about ⅛ inch to form a coal compact having a specific gravity of at least about 1.1;

(b) breaking the thus formed compact such that the bulk density is sufficiently increased to be capable of conversion into coke suitable for use in large blast furnaces upon carbonization thereof and wherein the following particle sizes of broken compacts are produced by this breaking step:

(1) particle size greater than 1 inch in diameter present in an amount of less than about 5 percent by weight;

(2) particle size less than about 1 inch in diameter to about ¼ inch present in an amount of between about 20 percent by weight to about 50 percent by weight;

(3) particle size less than about ¼ inch in diameter to about 100 mesh present in an amount of between about 40 percent by weight to about 70 percent by weight;

(4) particle size less than about 100 mesh present in an amount of between about 5 percent by weight and about 30 percent by weight;

(c) charging the coking oven with the broken compact; and (d) subjecting the oven contents to carbonization at a temperature between about 1650° and about 2000° F. and at a coking rate of greater than about 1 inch per hour to thereby produce blast furnace coke having a minimum hardness of about 68 and a minimum stability of about 55.

23. Method as in claim 22 wherein the compaction step is carried out by first passing the finely divided blended coal through a pair of precompaction rolls followed by one or more pairs of compacting rolls and wherein pressure applied between both sets of rolls is between about 20 and about 60 tons per lineal inch of roll length.

24. Method as in claim 23 wherein the compact formed by passing through the precompaction rolls is broken before being passed through one or more pairs of compacting rolls.

* * * * *